US005918099A

United States Patent [19]

Schlueter, Jr. et al.

[11] Patent Number: 5,918,099

[45] Date of Patent: Jun. 29, 1999

[54] FUSER COMPONENTS WITH POLYPHENYLENE SULFIDE LAYER

[75] Inventors: Edward L. Schlueter, Jr., Rochester; James F. Smith, Ontario, both of N.Y.

[73] Assignee: Xerox Corporation, Stamford, Conn.

[21] Appl. No.: 09/070,186

[22] Filed: Apr. 30, 1998

[51] Int. Cl.[6] ..... G03G 15/20; G03G 15/04; H05B 1/00; H05B 3/00

[52] U.S. Cl. ..... 399/333; 399/329; 399/330; 219/216; 219/470; 430/66

[58] Field of Search ..... 399/333, 330; 219/216, 469, 470; 430/47, 58, 66

[56] References Cited

U.S. PATENT DOCUMENTS

| | | | |
|---|---|---|---|
| 4,839,673 | 6/1989 | Kegelman et al. | 346/160.1 |
| 5,258,252 | 11/1993 | Sakai et al. | 430/66 |
| 5,272,029 | 12/1993 | Sakai et al. | 430/58 |
| 5,298,956 | 3/1994 | Mammino et al. | 355/275 |
| 5,409,557 | 4/1995 | Mammino et al. | 156/137 |
| 5,525,446 | 6/1996 | Sypula et al. | 430/47 |
| 5,536,352 | 7/1996 | Zeman | 156/242 |
| 5,763,129 | 6/1998 | Chen et al. | 430/99 |
| 5,765,085 | 6/1998 | Law et al. | 399/239 |

*Primary Examiner*—Richard Moses
*Assistant Examiner*—Shival Virmani
*Attorney, Agent, or Firm*—Annette L. Bade

[57] ABSTRACT

A fuser member having a polyimide substrate, an optional solventless intermediate adhesive layer, an outer polyphenylene sulfide layer, and an optional outer release layer, which provides enhanced bonding and decreased occurrence of delamination is provided. An image forming apparatus using the fuser member is also disclosed.

22 Claims, 3 Drawing Sheets

FUSER COMPONENTS WITH POLYPHENYLENE SULFIDE LAYER

CROSS REFERENCE TO RELATED APPLICATIONS

Attention is directed to copending application Attorney Docket Number D/96143, U.S. patent application Ser. No. 08/069,713, filed Apr. 30, 1998, entitled, "Intermediate Transfer Components with Polyphenylene Sulfide Outer Layer." The disclosure of this application is hereby incorporated by reference in its entirety.

BACKGROUND OF THE INVENTION

The present invention relates to fuser components useful in fusing a developed image in an electrostatographic, including xerographic and digital, machine. In embodiments of the present invention, there are selected fuser components comprising an outer layer comprising a polymer, preferably a polyphenylene sulfide. In embodiments, the fuser member comprises a polyimide substrate, an optional solventless adhesive layer and a polyphenylene sulfide outer layer. In embodiments, there is an outer release layer positioned on the outer polyphenylene sulfide layer. In embodiments, the fuser layers are corona treated prior to lamination with an adhesive. The present invention, in embodiments, allows for the preparation and manufacture of fuser components with a lower dissipation factor, lower thermal expansion, and higher modulus. Further, in embodiments, the fuser components exhibit excellent properties such as less water and oxygen uptake and excellent electrical properties. Moreover, in embodiments, the fuser components have excellent mechanical properties including improved adhesion and reduced or eliminated delamination.

In a typical electrostatographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. The visible toner image is then in a loose powdered form and can be easily disturbed or destroyed. The toner image is usually fixed or fused upon a support which may be the photosensitive member itself or other support sheet such as plain paper.

The use of thermal energy for fixing toner images onto a support member is well known and normally requires heating the toner image to a temperature of between about 90° C. to about 200° C. or higher depending upon the softening range of the particular resin used in the toner. It is undesirable, however, to increase the temperature of the substrate substantially higher than about 250° C. because of the tendency of the substrate to discolor or convert into fire at such elevated temperatures, particularly when the substrate is paper.

Several approaches to thermal fusing of electroscopic toner images have been described. These methods include providing the application of heat and pressure substantially concurrently by various means, a roll pair maintained in pressure contact, a belt member in pressure contact with a roll, a belt member in pressure contact with a heater, and the like. Heat may be applied by heating one or both of the rolls, plate members, or belt members. The fusing of the toner particles takes place when the proper combination of heat, pressure and contact time are provided. The balancing of these parameters to enable the fusing of the toner particles is well known in the art, and can be adjusted to suit particular machines or process conditions.

It is important in the fusing process that minimal or no offset of the toner particles from the support to the fuser member take place during normal operations. Toner particles offset onto the fuser member may subsequently transfer to other parts of the machine or onto the support in subsequent copying cycles, thus increasing the background or interfering with the material being copied there. The referred to "hot offset" occurs when the temperature of the toner is increased to a point where the toner particles liquefy and a splitting of the molten toner takes place during the fusing operation with a portion remaining on the fuser member. The hot offset temperature or degradation of the hot offset temperature is a measure of the release property of the fuser, and accordingly it is desired to provide a fusing surface which has a low surface energy to provide the necessary release. To ensure and maintain good release properties of the fuser, it has become customary to apply release agents to the fuser member during the fusing operation. Typically, these materials are applied as thin films of, for example, silicone oils to prevent toner offset.

With the fixing apparatus using a thin film in pressure contact with a heater, the electric power consumption is small, and the warming-up period is significantly reduced or eliminated. In the film embodiments, it is necessary for the film material to comprise a material which is flexible, yet able to maintain its mechanical and electrical properties over a wide temperature range. Problems have resulted in that elastomer materials tend to lose about 70 to 90% of their mechanical strength at high operating temperatures, for example about 190° C. In an attempt to solve the lack of strength problems, multiple layered film systems, for example from 2 to 5 layers, have been developed. However, problems with delamination have occurred with fusing or film systems, which include 2 or more layers, in that the outer surface tends to pull away from the substrate upon multiple revolutions of the belt or film substrate during the fusing process. In addition, processes for preparation of such multilayered fusing films have not been successful at forming uniform thicknesses of the outer layer(s) of the belt or film.

It is desired to provide a fuser member which possesses many or all of the qualities required for optimum function. Higher modulus, lower thermal expansion, excellent electrical properties, better flex life and decreased costs are desired properties. Other desired properties include wear resistance, cleanability and seamability. In addition, desirable properties include lower water and oxygen uptake.

SUMMARY OF THE INVENTION

Embodiments of the present invention include: a fuser member comprising a substrate comprising a polyimide, an optional adhesive layer and an outer layer comprising polyphenylene sulfide.

In addition, embodiments include: an image forming apparatus for forming images on a recording medium comprising: a charge-retentive surface to receive an electrostatic latent image thereon; a development component to apply toner to the charge-retentive surface to develop the electrostatic latent image to form a developed image on the charge retentive surface; a transfer component to transfer the developed image from the charge retentive surface to a copy substrate; and a fuser member to fuse the developed image to the copy substrate, the fuser member comprising a substrate comprising a polyimide, an optional adhesive layer, and an outer layer comprising polyphenylene sulfide.

Moreover, embodiments include: a fuser member comprising a substrate comprising a polyimide, an adhesive layer positioned thereon wherein the adhesive layer comprises a solventless adhesive, and an outer layer positioned on the adhesive layer wherein the outer layer comprises polyphenylene sulfide, and wherein at least one of the polyimide substrate and the polyphenylene sulfide outer layer are subjected to corona treatment prior to positioning the solventless adhesive between the polyimide substrate and the polyphenylene sulfide outer layer.

BRIEF DESCRIPTION OF THE DRAWINGS

For a better understanding of the present invention, reference may be had to the accompanying figures.

DETAILED DESCRIPTION OF THE PRESENT INVENTION

The present invention relates to fuser members comprising a polyphenylene sulfide outer layer, and, in embodiments, fuser members having a polyimide substrate, optional adhesive layer (preferably a solventless adhesive) and outer polyphenylene sulfide layer. Further, in embodiments, an outer release layer can be provided on the polypropylene sulfide outer layer. In addition, in embodiments, at least one of the substrate and outer layer(s) is subjected to corona treatment prior to lamination with an adhesive.

Figure 1:
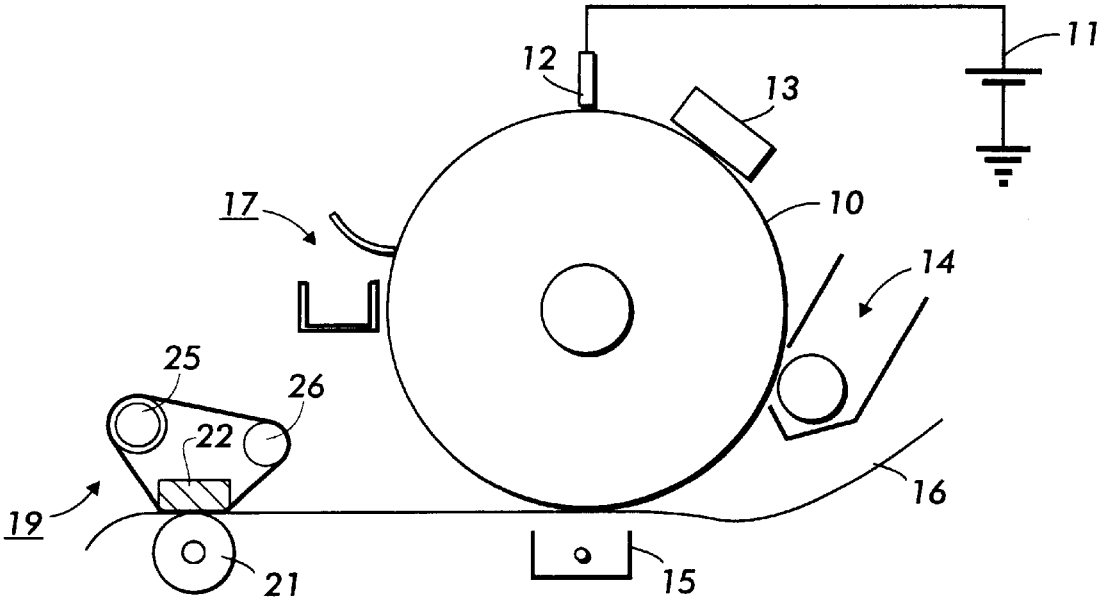
FIG. 1 is a schematic illustration of an image apparatus in accordance with the present invention.

Referring to FIG. 1, in a typical electrostatographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. Specifically, photoreceptor 10 is charged on its surface by means of a charger 12 to which a voltage has been supplied from power supply 11. The photoreceptor is then imagewise exposed to light from an optical system or an image input apparatus 13, such as a laser and light emitting diode, to form an electrostatic latent image thereon. Generally, the electrostatic latent image is developed by bringing a developer mixture from developer station 14 into contact therewith. Development can be effected by use of a magnetic brush, powder cloud, or other known development process. A dry developer mixture usually comprises carrier granules having toner particles adhering triboelectrically thereto. Toner particles are attracted from the carrier granules to the latent image forming a toner powder image thereon. Alternatively, a liquid developer material may be employed, which includes a liquid carrier having toner particles dispersed therein. The liquid developer material is advanced into contact with the electrostatic latent image and the toner particles are deposited thereon in image configuration.

After the toner particles have been deposited on the photoconductive surface, in image configuration, they are transferred to a copy sheet 16 by transfer means 15, which can be pressure transfer or electrostatic transfer. Alternatively, the developed image can be transferred to an intermediate transfer member, or bias transfer member, and subsequently transferred to a copy sheet. Examples of copy substrates include paper, transparency material such as polyester, polycarbonate, or the like, cloth, wood, or any other desired material upon which the finished image will be situated.

After the transfer of the developed image is completed, copy sheet 16 advances to fusing station 19, depicted in FIG. 1 as fuser belt 20 with heater 22, and driving rollers 25 and follower roller 26 and pressure roll 21 (although any other fusing components such as fuser roll in contact with a pressure roll, fuser roll in contact with pressure belt, and the like, are suitable for use with the present apparatus), wherein the developed image is fused to copy sheet 16 by passing copy sheet 16 between the fusing and pressure members, thereby forming a permanent image. Alternatively, transfer and fusing can be effected by a transfix application.

Photoreceptor 10, subsequent to transfer, advances to cleaning station 17, wherein any toner left on photoreceptor 10 is cleaned therefrom by use of a blade (as shown in FIG. 1), brush, or other cleaning apparatus.

The fuser members employed for the present invention can be of any suitable configuration. Examples of suitable configurations include a sheet, a film, a web, a foil, a strip, a coil, a cylinder, a drum, an endless mobius strip, a circular disc, a belt including an endless belt, an endless seamed flexible belt, an endless seamless flexible belt, an endless belt having a puzzle cut seam, and the like.

Figure 2:
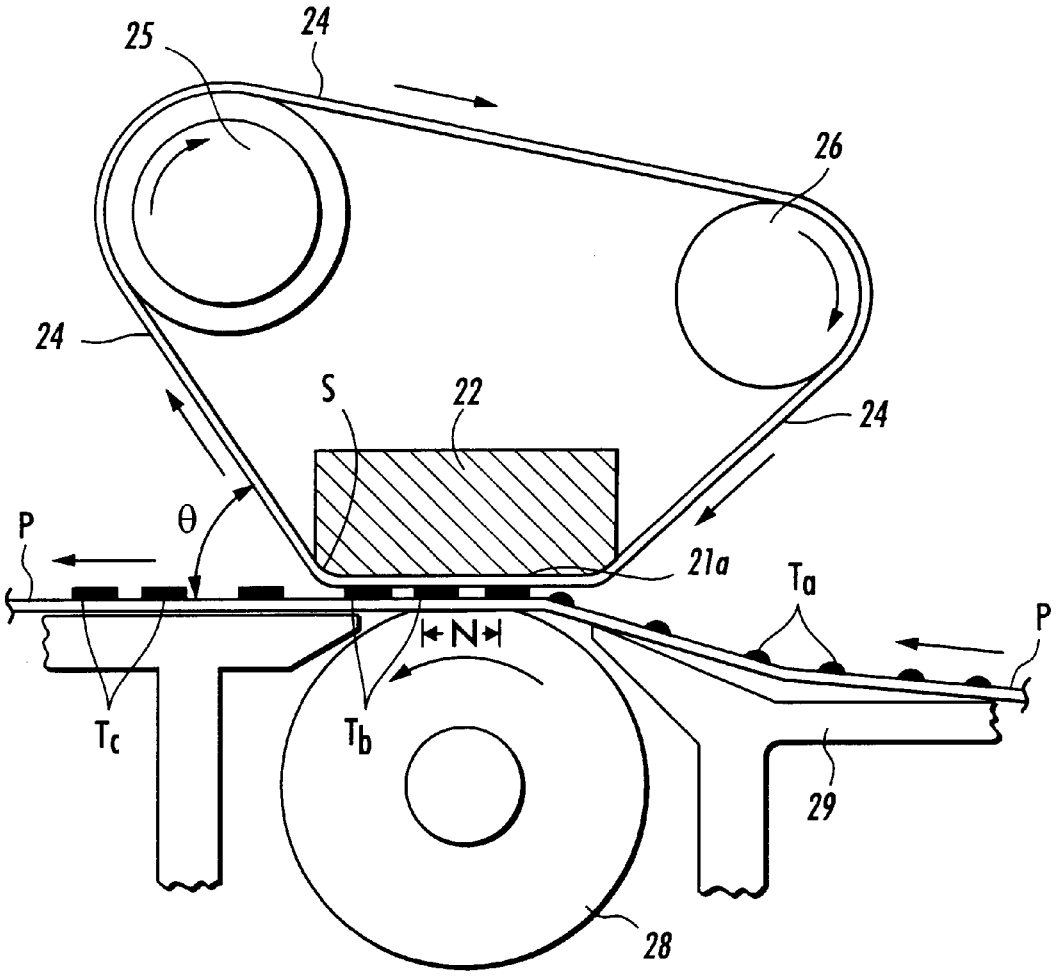
FIG. 2 shows a sectional view of an example of a heating apparatus according to an embodiment of the present invention.

FIG. 2 shows a sectional view of an example of a heating apparatus according to an embodiment of the present invention. In FIG. 2, a heat resistive film or an image fixing film 24 in the form of an endless belt is trained or contained around three parallel members, i.e., a driving roller 25, a follower roller 26 of metal and a low thermal capacity linear heater 22 disposed between the driving roller 25 and the follower roller 26.

The follower roller 26 also functions as a tension roller for the fixing film 24. The fixing film rotates at a predetermined peripheral speed in the clockwise direction by the clockwise rotation of the driving roller 25. The peripheral speed is the same as the conveying speed of the sheet having an image thereon (not shown) so that the film is not creased, skewed or delayed.

A pressing roller 28 has a rubber elastic layer with parting properties, such as silicone rubber or the like, and is press-contacted to the heater 22 with the bottom travel of the fixing film 24 therebetween. The pressing roller is pressed against the heater at the total pressure of 4–7 kg by an urging means (not shown). The pressure roller rotates co-directionally, that is, in the counterclockwise direction, with the fixing film 24.

The heater 22 is in the form of a low thermal capacity linear heater extending in a direction crossing with the film 24 surface movement direction (film width direction).

Upon an image formation start signal, an unfixed toner image is formed on a recording material at the image forming station. The recording material sheet P having an unfixed toner image Ta thereon is guided by a guide 29 to enter between the fixing film 24 and the pressing roller 28 at the nip N (fixing nip) provided by the heater 22 and the pressing roller 28. Sheet P passes through the nip between the heater 22 and the pressing roller 28 together with the fixing film 24 without surface deviation, crease or lateral shifting while the toner image carrying surface is in contact with the bottom surface with the fixing film 24 moving at the same speed as sheet P. The heater 22 is supplied with electric power at a predetermined timing after generation of the image formation start signal so that the toner image is heated at the nip so as to be softened and fused into a softened or fused image Tb.

Fixing film 24 is sharply bent at an angle theta of, for example, about 45 degrees at an edge S (the radius of curvature is approximately 2 mm), that is, the edge having a large curvature in the heater 22. Therefore, the sheet advanced together with the film 24 in the nip is separated by the curvature from the fixing film 24 at edge S. Sheet P is then discharged to the sheet discharging tray. By the time Sheet P is discharged, the toner has sufficiently cooled and solidified and therefore is completely fixed (toner image Tc).

The toner of resin and pigment used in this embodiment has a sufficiently high viscosity when it is heated and fused. Therefore, even if the toner temperature when it is separated from the fixing film is higher than the toner fusing point, the bonding strength among toner particles is very large when compared to the strength between the toner and the fixing films. Therefore, practically no toner offset is produced and carried over onto fixing film 24 when fixing film 24 and sheet P is separated.

In this embodiment, heater element 22 has low thermal capacity. The surface temperature of heater 22 in the nip quickly reaches a sufficiently high temperature which is necessary in order to fuser the toner. Also, a stand-by temperature control is used to increase the temperature of the heater 22 to a predetermined level. Therefore, power consumption can be reduced, and rise in temperature can be prevented.

The fixing film 24 is in contact with the heater 22. The distance between the outer layer of the fixing film and the heater is preferably not less than 2.5 mm, and preferably not less than 5 mm. Similarly, the distance between the fixing film and the grounded rollers 25 and 26 is not less than 5 mm. These distances prevent leakage of the charge applied to the transfer material P by an image (not shown) forming station from leaking to the ground through the transfer material P. Therefore, possible deterioration of image quality due to improper image transfer can be avoided.

In another embodiment of the invention, not shown in the figures, the fixing film may be in the form of a sheet. For example, a non-endless film may be rolled on a supply shaft and taken out to be wrapped on a take-up shaft through the nip between the heater and the pressing roller. Thus, the film may be fed from the supply shaft to the take-up shaft at the speed which is equal to the speed of the transfer material. This embodiment is described and shown in U.S. Pat. No. 5,157,446, the disclosure of which is hereby incorporated by reference in its entirety.

Figure 3:
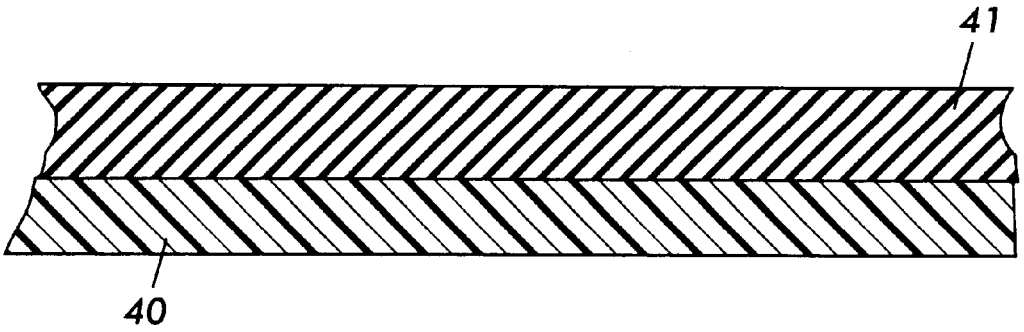
FIG. 3 is an illustration of an embodiment of the invention, wherein a two layer fuser film comprising a substrate and an outer polyphenylene sulfide layer as described herein is shown.

FIG. 3 demonstrates a two layer configuration of an embodiment of the present invention. Included therein is a substrate 40 and outer polyphenylene sulfide layer 41. Preferably, the substrate is comprised of a suitable high elastic modulus material such as a polyimide material. The material should be capable of becoming thermally conductive upon the addition of electrically conductive particles. A polyimide having a high elastic modulus is preferred because the high elastic modulus optimizes the stretch registration necessary for the fuser belt to undergo many successions around fuser rollers. The polyimide used herein has the advantages of improved flex life and image registration, chemical stability to liquid developer or toner additives, thermal stability for fixing applications and for improved overcoating manufacturing, improved solvent resistance as compared to known materials used for film for fusing components.

Suitable polyimides include those formed from various diamines and dianhydrides, such as poly(amide-imide), polyetherimide, siloxane polyetherimide block copolymer such as, for example, SILTEM STM-1300 available from General Electric, Pittsfield, Mass., and the like. Preferred polyimides include aromatic polyimides such as those formed by the reacting pyromellitic acid and diaminodiphenylether sold under the tradename KAPTON®-type-HN, available from DuPont. Another suitable polyimide available from DuPont and sold as KAPTON®-Type-FPC-E, is produced by imidization of copolymeric acids such as biphenyltetracarboxylic acid and pyromellitic acid with two aromatic diamines such as p-phenylenediamine and diaminodiphenylether. Another suitable polyimide includes pyromellitic dianhydride and benzophenone tetracarboxylic dianhydride copolymeric acids reacted with 2,2-bis[4-(8-aminophenoxy) phenoxy]-hexafluoropropane available as EYMYD type L-20N from Ethyl Corporation, Baton Rouge, La. Other suitable aromatic polyimides include those containing 1,2,1', 2'-biphenyltetracarboximide and paraphenylene groups such as UPILEX®-S available from Uniglobe Kisco, Inc., White Planes, N.Y., and those having biphenyltetracarboximide functionality with diphenylether end spacer characterizations such as UPILEX®-R also available from Uniglobe Kisco, Inc. Mixtures of polyimides can also be used.

The polyimide is present in the film in an amount of from about 60 to about 99.9 percent by weight of total solids, preferably from about 80 to about 90 percent by weight of total solids. Total solids as used herein includes the total percentage by weight of polymer, conductive fillers and any additives in the layer.

The outer layer 41 of the fuser member herein is preferably polyphenylene sulfide. Any known and/or commercially available polyphenylene sulfide may be used as the outer layer of the fuser member. Polyphenylene sulfide is a polymer composed of a series of alternating aromatic rings and sulfur atoms. Polyphenylene sulfide can be prepared through the synthesis of 1,4-dichlorobenzene and sodium sulfide. Polyphenylene sulfide combines favorable electrical characteristics with high thermal stability and chemical resistance. Preferred examples of polyphenylene sulfides include those sold under the tradename TORELINA®, available from Toray Marketing & Sales (America), Inc., New York, N.Y.; RYTONTM™ available from ICI Films of Wilmington, Del. and Toray Industries, and the like.

The polyphenylene sulfide provides preferable results as compared to known materials such as polyimide, polyester and polycarbonate, useful as outer layers of fuser members. For example, polyphenylene sulfide has a greater modulus (from about 200,000 to about 750,000, preferably from about 400,000 to about 550,000 PSI for polyphenylene sulfide as compared to from about 150,000 to about 350,000 PSI for polycarbonate), lower cost, and lower water absorption (0.05 percent for polyphenylene sulfide as compared to 0.25 to 2.2 percent for polyimide). These properties are important for stability of the mechanical, electrical and chemical properties during function in xerographic processes. Another superior property of polyphenylene sulfide is that it is a high temperature thermal plastic material. This is important in that a thermal set material is harder to seam. Moreover, polyphenylene sulfide is more temperature resistant than polyesters. Polyphenylene sulfide has been shown to have lower friction and lower wear rates than polyimides. In addition, polyphenylene sulfide has been shown to exhibit easier toner cleanability than polyimide. For example, toner removal tests have shown that air velocity of about 107 ft/sec was required to remove toner from a polyimide material. When polyphenylene sulfide was tested under the same conditions, a lower air velocity of about 87 ft/sec was required to remove toner from the material surface. Tests such as these demonstrate that the polyphenylene sulfide surface provides a surface which exhibits easier toner cleanability than polyimide.

The polyphenylene sulfide is present in the outer layer in an amount of from about 60 to about 99.9, and preferably from about 80 to about 90 percent by weight of total solids. Total solids as used herein refers to the total amount of solid material in the layer, including polymer, filler, additives and other solids.

Figure 4:
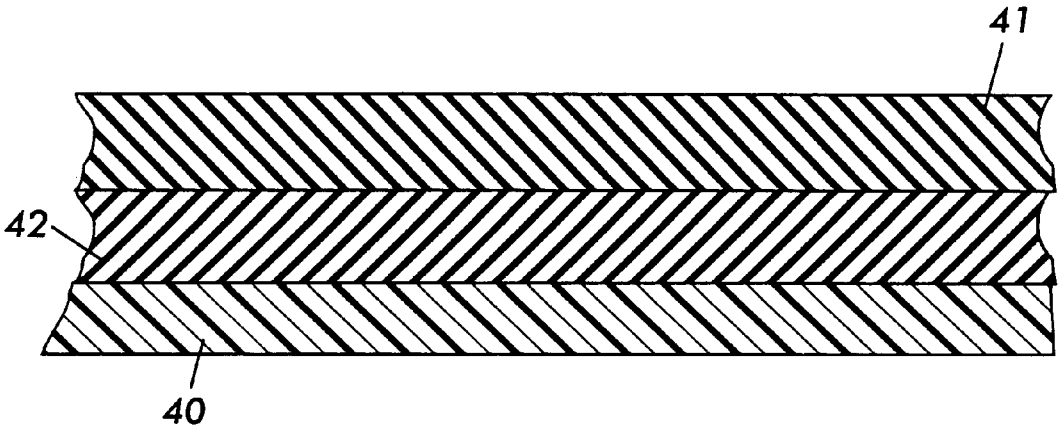
FIG. 4 is an illustration of an embodiment of the invention, wherein a three layer fuser film having a substrate, an adhesive intermediate layer and an outer polyphenylene sulfide layer as described herein is shown.

In another preferred embodiment of the invention, the fuser member is of a three layer configuration as shown in FIG. 4. This three layer configuration provides superior conformability and is suitable for use with liquid toner, and especially in color xerographic machines. In this three layer configuration, the fuser member comprises a substrate 40 as defined above, and having thereon an intermediate layer 42 comprised of an adhesive, (preferably a solventless adhesive) positioned on the substrate, and an outer release layer 41 of polyphenylene sulfide. The three layer configuration works very well with liquid development and is the preferred configuration of the present invention.

In the case of a three layer configuration, very strong adhesives are required in order to prevent or reduce the occurrence of delamination, or the pulling away of the outer layer from the substrate. Delamination is caused by the excessive force due to the numerous turns of a roller, or numerous revolutions of a belt around a set of rollers during normal machine operations. It is preferable to use higher molecular weight adhesives. Typically, the higher molecular weight adhesives require dissolving in a solvent for processing. However, a problem arises when using such adhesives with solvents. First, environmental and ventilation problems arise, and also, higher costs are associated with handling of the solvents. Second, problems result from boiling the solvent during processing which leaves bubbles and flaws in the adhering surfaces. This can result in incomplete and uneven lamination of the outer layer on the adhesive surface. However, by use of solventless adhesives, the above drawbacks have been reduced or eliminated. In addition, the pull strength of the adhesive is increased by use of solventless adhesives in combination with the layers described herein, resulting in reducing or eliminating the occurrence of delamination.

Therefore, it is preferable to use solventless adhesives with the fuser members of the present invention. Solventless adhesive, as used herein, refers to materials that are liquid at room temperature (about 25° C.) and are able to crosslink to an elastic or rigid film to adhere at least two materials together. These solventless adhesive materials contain from about 0 to about 5 percent, preferably from about 0.01 to about 3 percent, and particularly preferred from about 0.01 to about 1 percent volatile or solvent material. There are several chemical classes of solventless adhesives such as epoxy, urethane, silicones, and the like. Specific examples include 100 percent solids adhesives including polyurethane adhesives from Lord Corporation, Erie, Pa., such as TYCEL® 7924 (viscosity from about 1400 to about 2000 cps), TYCEL® 7975 (viscosity from about 1200 to about 1600 cps) and TYCEL® 7276. The viscosity range of the adhesives is from about 1200 to about 2000 cps. The solventless adhesives can be activated with either heat, room temperature curing, moisture curing, ultraviolet radiation, infrared radiation, electron beam curing or any other known technique.

Use of solventless adhesives such as those identified above enables fluid systems with higher bonding strengths without the solvent problems. The pull strength of one of the preferred three layer embodiments described herein is at least about 50 ounce/inch, preferably greater than about 200 ounce/inch, and most preferably from about 300 to about 400 ounce/inch.

Figure 5:
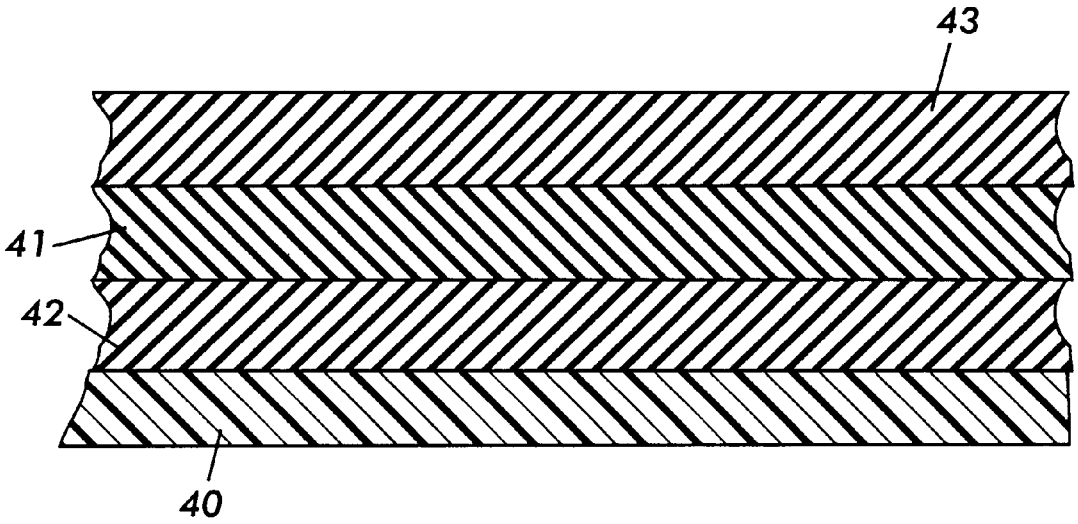
FIG. 5 is an illustration of another embodiment of the invention and demonstrates a four layer fuser configuration including a substrate, intermediate adhesive layer, outer polyphenylene sulfide layer and outer release layer.

In another embodiment, as shown in FIG. 5, the polyphenylene sulfide outer layer can include an outer release layer 43 positioned on the polyphenylene sulfide outer layer 41. Preferred outer release layers include low surface energy materials such as TEFLON®-like materials including fluorinated ethylene propylene copolymer (FEP), polytetrafluoroethylene (PTFE), polyfluoroalkoxy polytetrafluoroethylene (PFA TEFLON®) and other TEFLON®-like materials; silicone materials such as fluorosilicones and silicone rubbers such as Silicone Rubber 552, available from Sampson Coatings, Richmond, Va., (polydimethyl siloxane/dibutyl tin diacetate, 0.45 g DBTDA per 100 grams polydimethyl siloxane rubber mixture, with molecular weight of approximately 3,500); and fluoroelastomers such as those sold under the tradename VITON® such as copolymers and terpolymers of vinylidenefluoride, hexafluoropropylene and tetrafluoroethylene, which are known commercially under various designations as VITON A®, VITON E®, VITON E60C®, VITON E45®, VITON E430®, VITON B 910®, VITON GH®, VITON B50®, VITON E45®, and VITON GF®. The VITON® designation is a Trademark of E.I. DuPont de Nemours, Inc. Two preferred known fluoroelastomers are (1) a class of copolymers of vinylidenefluoride, hexafluoropropylene and tetrafluoroethylene, known nummercially as VITON® A, (2) a class of terpolymers of vinylidenefluoride, hexafluoropropylene and tetrafluoroethylene known commercially as VITON B®, and (3) a class of tetrapolymers of vinylidenefluoride, hexafluoropropylene, tetrafluoroethylene and a cure site monomer such as VITON GF® having 35 mole percent of vinylidenefluoride, 34 mole percent of hexafluoropropylene and 29 mole percent of tetrafluoroethylene with 2 percent cure site monomer. The cure site monomer can be those available from DuPont such as 4-bromoperfluorobutene-1, 1,1-dihydro-4-bromoperfluorobutene-1, 3-bromoperfluoropropene-1, 1,1-dihydro-3-bromoperfluoropropene-1, or any other suitable, known, commercially available cure site monomer.

Examples of fluoroelastomers suitable for use herein for the outer layer of the fixing film include elastomers of the above type, along with volume grafted elastomers. Volume grafted elastomers are a special form of hydrofluoroelastomer and are substantially uniform integral interpenetrating networks of a hybrid composition of a fluoroelastomer and a polyorganosiloxane, the volume graft having been formed by dehydrofluorination of fluoroelastomer by a nucleophilic dehydrofluorinating agent, followed by addition polymerization by the addition of an alkene or alkyne functionally terminated polyorganosiloxane and a polymerization initiator. Examples of specific volume graft elastomers are disclosed in U.S. Pat. No. 5,166,031; U.S. Pat. No. 5,281,506; U.S. Pat. No. 5,366,772; and U.S. Pat. No. 5,370,931, the disclosures each of which are herein incorporated by reference in their entirety.

Volume graft, in embodiments, refers to a substantially uniform integral interpenetrating network of a hybrid composition, wherein both the structure and the composition of the fluoroelastomer and polyorganosiloxane are substantially uniform when taken through different slices of the fuser member. A volume grafted elastomer is a hybrid composition of fluoroelastomer and polyorganosiloxane formed by dehydrofluorination of fluoroelastomer by nucleophilic dehydrofluorinating agent followed by addition polymerization by the addition of alkene or alkyne functionally terminated polyorganosiloxane Interpenetrating network, in embodiments, refers to the addition polymerization matrix where the fluoroelastomer and polyorganosiloxane polymer strands are intertwined in one another.

Hybrid composition, in embodiments, refers to a volume grafted composition which is comprised of fluoroelastomer and polyorganosiloxane blocks randomly arranged.

Generally, the volume grafting according to the present invention is performed in two steps, the first involves the dehydrofluorination of the fluoroelastomer preferably using an amine. During this step, hydrofluoric acid is eliminated which generates unsaturation, carbon to carbon double bonds, on the fluoroelastomer. The second step is the free radical peroxide induced addition polymerization of the alkene or alkyne terminated polyorganosiloxane with the carbon to carbon double bonds of the fluoroelastomer. In embodiments, copper oxide can be added to a solution containing the graft copolymer. The dispersion is then provided onto the fuser member or conductive film surface.

In embodiments, the polyorganosiloxane having functionality according to the present invention has the formula:

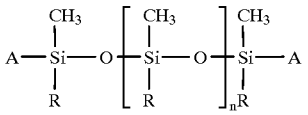

where R is an alkyl from about 1 to about 24 carbons, or an alkenyl of from about 2 to about 24 carbons, or a substituted or unsubstituted aryl of from about 4 to about 18 carbons; A is an aryl of from about 6 to about 24 carbons, a substituted or unsubstituted alkene of from about 2 to about 8 carbons, or a substituted or unsubstituted alkyne of from about 2 to about 8 carbons; and n represents the number of segments and is, for example, from about 2 to about 400, and preferably from about 10 to about 200 in embodiments.

In preferred embodiments, R is an alkyl, alkenyl or aryl, wherein the alkyl has from about 1 to about 24 carbons, preferably from about 1 to about 12 carbons; the alkenyl has from about 2 to about 24 carbons, preferably from about 2 to about 12 carbons; and the aryl has from about 6 to about 24 carbon atoms, preferably from about 6 to about 18 carbons. R may be a substituted aryl group, wherein the aryl may be substituted with an amino, hydroxy, mercapto or substituted with an alkyl having for example from about 1 to about 24 carbons and preferably from 1 to about 12 carbons, or substituted with an alkenyl having for example from about 2 to about 24 carbons and preferably from about 2 to about 12 carbons. In a preferred embodiment, R is independently selected from methyl, ethyl, and phenyl. The functional group A can be an alkene or alkyne group having from about 2 to about 8 carbon atoms, preferably from about 2 to about 4 carbons, optionally substituted with an alkyl having for example from about 1 to about 12 carbons, and preferably from about 1 to about 12 carbons, or an aryl group having for example from about 6 to about 24 carbons, and preferably from about 6 to about 18 carbons. Functional group A can also be mono-, di-, or trialkoxysilane having from about 1 to about 10 and preferably from about 1 to about 6 carbons in each alkoxy group, hydroxy, or halogen. Preferred alkoxy groups include methoxy, ethoxy, and the like. Preferred halogens include chlorine, bromine and fluorine. Functional group A may also be an alkyne of from about 2 to about 8 carbons, optionally substituted with an alkyl of from about 1 to about 24 carbons or aryl of from about 6 to about 24 carbons. The group n is from about 2 to about 400, and in embodiments from about 2 to about 350, and preferably from about 5 to about 100. Furthermore, in a preferred embodiment n is from about 60 to about 80 to provide a sufficient number of reactive groups to graft onto the fluoroelastomer. In the above formula, typical R groups include methyl, ethyl, propyl, octyl, vinyl, allylic crotnyl, phenyl, naphthyl and phenanthryl, and typical substituted aryl groups are substituted in the ortho, meta and para positions with lower alkyl groups having from about 1 to about 15 carbon atoms. Typical alkene and alkenyl functional groups include vinyl, acrylic, crotonic and acetenyl which may typically be substituted with methyl, propyl, butyl, benzyl, tolyl groups, and the like.

In another preferred embodiment, the polyphenylene sulfide outer layer may be subjected to surface fluorination with fluorine gas as an alternative to the inclusion of an outer release layer. By providing the surface fluorination, or alternatively, addition of an outer low surface energy material such as those listed above, the surface energy of the polyphenylene sulfide outer coating can be reduced.

It is preferred that one or all of the layers contain a conductive filler to provide thermal conductivity to the fuser belt. A preferred filler is one which is capable of interacting with the functional groups of the polymeric release agent which is used in a preferred embodiment, to form a thermally stable film which releases the thermoplastic resin toner and prevents the toner from contacting the elastomer material itself. In addition, it is preferred that the metal oxide be substantially non-reactive with the elastomer so as not to chemically react with the layer materials. Examples of thermally conductive fillers include carbon black, graphite, boron nitride, metal oxides such as nickel oxide, ferric oxide, manganese oxide, molybdenum oxide, copper oxide, zinc oxide, aluminum oxide, titanium dioxide, silicone dioxide, and the like. Preferably, the outer layer(s) such as the polyphenylene sulfide outer layer and optional outer release layer, comprise a filler such as those just listed. The polyimide substrate can also comprise known fillers. The metal oxide is preferably present in an amount of from about 5 to 30 parts by weight per hundred parts of the elastomer although it is preferred to have from about 10 to 20 parts by weight of metal oxide. In addition, the particle size of the metal oxide is preferably not so small as to interfere with the curing of the layer nor so large as to supply an insufficient number of particles disbursed throughout the layer surface for good release properties. Preferably, the metal oxide particles have a mean diameter of from about 2 to 10 microns, preferably 6 microns.

Any suitable release agent may be used including polyorganosiloxane fluids, amino oils, and the like. Preferred polymeric fluid release agents are those having functional groups which interact with the metal oxide particles in the fuser member in such a manner to form an interfacial barrier at the surface of the fuser member while leaving a non-reacted low surface energy release fluid as an outer release film. Examples of suitable release agents having functional groups include those described in U.S. Pat. Nos. 4,046,795; 4,029,827; and 4,011,362; 4,101,686; 4,146,659; 4,150,181; 4,185,140; 4,515,884; 5,395,725; and 5,493,326. In preferred embodiments, the chemically reactive groups of the polymeric release agents are mercapto, carboxy, hydroxy, isocyanate, epoxy and amino. Preferred amino functional oils include those disclosed in, for example, U.S. Pat. Nos. 5,512,409; 5,516,361 and 5,531,813. Other preferred fuser oils include hydride oils such as those disclosed in U.S. Pat. No. 5,401,570. In the case of a silicone rubber outer layer, it is preferred to use polydimethylsiloxane fuser oils. In the case of a fluoroelastomer outer layer, it is preferred to use amino functional oils, or other functional oils that interact with the outer surface to form a release layer.

The film is from about 3 to about 120 inches, preferably from about 4 to about 30 inches in circumference. The width of the film is from about 8 to about 30 inches. It is preferably that the substrate be an endless, seamed flexible belt and seamed flexible belts, which may or may not include puzzle cut seams. Examples of such belts are described in U.S. Pat. Nos. 5,487,707; 5,514,436; and U.S. patent application Ser. No. 08/297,203 filed Aug. 29, 1994, the disclosures each of which are incorporated herein by reference in their entirety. A method for manufacturing reinforced seamless belts is set forth in U.S. Pat. No. 5,409,557, the disclosure of which is hereby incorporated by reference in its entirety. Other techniques which can also be used for fabricating films or belts include ultrasonic or impulse welding.

The layer or layers may be deposited on the substrate via a well known coating processes. Known methods for forming the outer layer(s) on the substrate film such as dipping, spraying such as by multiple spray applications of very thin films, casting, flow-coating, web-coating, roll-coating, extrusion, molding, or the like can be used. It is preferred to deposit the layers by spraying such as by multiple spray applications of very thin films, casting, by web coating, by flow-coating and by laminating.

Flow coating the outer layer to the substrate provides an outer layer which is less susceptible to delamination or pulling away from the substrate. Details of a flow coating procedure useful in preparing fixing films of the present invention can be found in U.S. application Ser. No. 08/669,761 filed Jun. 26, 1996, entitled, "LEVELING BLADE FOR FLOW COATING PROCESS FOR MANUFACTURE OF POLYMERIC PRINTER ROLL AND BELT COMPONENTS;" U.S. application Ser. No. 08/672,493 filed Jun. 26, 1996, entitled, "FLOW COATING PROCESS FOR MANUFACTURE OF POLYMERIC PRINTER ROLL AND BELT COMPONENTS;" U.S. application Ser. No. 08/824,576, filed Mar. 26, 1997, entitled "FUSER MEMBER WITH AN AMINO SILANE ADHESIVE LAYER AND PREPARATION THEREOF;" and U.S. application Ser. No. 08/822,521 filed Mar. 24, 1997, entitled "FLOW COATING SOLUTION AND FUSER MEMBER LAYERS PREPARED THEREWITH." The subject matter of each of these applications is incorporated herein in their entirety.

The thickness of the substrates or coatings as described herein is from about 2 microns to about 125 microns, preferably from about 8 to about 75 microns, and particularly preferred about 12 to about 25 microns.

The fuser film of the present invention may have additional layers of from about 1 to about 5 layers positioned between the substrate and the outer layer. These additional layers may be adhesive layers, reinforcing layers, and the like. The various layers impart mechanical strength, image and toner compatibility and proper nip dynamics to enable high quality images with little distortion at high process speeds. The substrate layer provides for mechanical strength and promotes adhesion. The outer layer provides superior image release in either liquid or powder architectures.

Prior to coating the outer layer on the substrate, adhesive layer or outer release layer, it is preferable to subject the surfaces to be laminated with a corona treatment. For example, in a preferred embodiment, prior to lamination with an adhesive intermediate layer, either the substrate and/or outer layer(s) are treated with corona. The pull strength can be increased 4 to 6 times as compared to no corona treatment.

All the patents and applications referred to herein are hereby specifically, and totally incorporated herein by reference in their entirety in the instant specification.

The following Examples further define and describe embodiments of the present invention. Unless otherwise indicated, all parts and percentages are by weight of total solids.

EXAMPLES

Example 1

Preparation of Polyphenylene Sulfide Laminate

A polyphenylene sulfide resin can be prepared by extrusion of dry pellets of polyphenylene sulfide (purchased from Toray Industries, New York, N.Y. or Phillips 66 Company, Bartlesville, Okla.) in a hot air oven or dryer at 120° C. for about 2 hours, followed by nitrogen gas purging at 250 to 290° C. in order to reduce black particles in the film. This is followed by subjecting the film to a reverse temperature profile at about 340° C. The film can then be subjected to melting at a temperature of about 300 to 310° C., followed by filtration in a 40 $\mu$m screen. The film can then be subjected to corona treatment which oxidizes and cleans the surface for improved adhesion. The film laminate can then be cast onto a roll or other substrate by any known method such as flow coating or spraying, followed by curing at a temperature of about 200° C. for up to 5 minutes. The polyphenylene sulfide can also be fabricated into a thin film sheet using typical melt processing and thin film fabrication techniques.

Example 2

Preparation of Fuser Roller with Polyphenylene Sulfide Outer Layer

Corona treated and non-corona treated aluminum rollers having the dimensions of 24 inches in width and 0.22 meters in length, respectively, were separately laminated with polyphenylene sulfide material (TORILINA® from Toray Industries, New York, N.Y.) prepared according to the procedures outlined in Example 1 to a thickness of 12 microns.

Example 3

Preparation of Two Layer Fuser Belt with Polyimide Substrate and Polyphenylene Sulfide Outer Layer A two layer fuser belt was prepared by laminating the polyphenylene outer layer formed in Example 1 onto a polyimide substrate (KAPTON® available from DuPont).

Example 4

Use of Solventless Adhesives with Polyimide Substrate (TYCEL® 7975 adhesive)

A polyphenylene sulfide laminate and polyimide substrate were formed using the procedures set forth in Examples 1 and 3 above, respectively. Solventless adhesive (TYCEL® 7975-A (adhesive) and 7276 (curing agent) both from Lord Corporation, Erie, Pa.) was purchased from Lord Corporation and used to bond the polyimide substrate to the polyphenylene sulfide outer layer using known methods. The three layer material was subjected to a pull strength test conductive using an Instron 1122 mechanical tester. A load cell of 50 pounds and a cross head speed of 10 inch/minute were used for the testing. A peel test was performed using the above conditions. The pull strength was found to be about 370 ounces/inch width. This was a factor of 10 higher than the typical 7180/7200 benchmark adhesion system which demonstrated approximately 22 ounce/inch using the same test procedure.

Example 5

Use of Solventless Adhesives with Polyimide Substrate (TYCEL® 7924 adhesive)

The procedure set forth in Example 4 was repeated except that the solventless adhesive TYCEL® 7924-A (adhesive) and 7924-B (curing agent) was replaced with TYCEL® 7975 (adhesive) and 7276 (curing agent), also from Lord Corporation. The pull strength was found to be about 370 ounces/inch.

Example 6

Use of Known Adhesives with Polyimide Substrate (TYCEL® 7180)

The procedure set forth in Example 4 was again repeated except that a known (not solventless) adhesive (TYCEL® 7180 (adhesive) and 7200 (curing agent) from Lord Corporation) was used as the adhesive. The pull strength was determined to be only about 22 ounce/inch width.

Examples 4–6 demonstrate that by use of a solventless adhesive, superior results are found as compared to use of known adhesives with a polyimide substrate and polyphenylene sulfide outer layer. The pull strength increased up to 16 times as much (22 versus 370 ounce/inch) by use of the claimed solventless adhesive.

Example 7

Use of Polycarbonate Substrate with Solventless Adhesive (TYCEL® 7924)

A melt extruded polycarbonate substrate (ICI PDX91149) was purchased from Mobay Corporation. The polyphenylene sulfide as prepared in Example 1 was bonded to the polycarbonate substrate using a solventless adhesive (TYCEL® 7924-A (adhesive) and 7924-B (curing agent) both available from Lord Corporation, Erie, Pa.). The three layer material was subjected to a pull strength test. The pull strength was found to be only 138 ounces/inch width. The toughness was found to be 1,507 in-lbs/in$^3$.

Example 8

Use of Polycarbonate Substrate with Known Adhesive (TYCEL® 7180)

A three layer belt was formed as in Example 7 (polycarbonate substrate and outer polyphenylene sulfide layer) except that a known (not solventless) adhesive (TYCEL® 7180 (adhesive) and 7200 (curing agent) both available from Lord Corporation, Erie, Pa.) was used. The three layer material was subjected to a pull strength test. The pull strength was found to be only about 8 ounces/inch width.

Examples 4–8 demonstrates that superior results are found by use of the combination of polyimide substrate, solventless adhesive and outer polyphenylene sulfide layer as compared to use of polycarbonate substrate in combination with either a known adhesive or a solventless adhesive.

Example 9

Cleanability of Polyphenylene Sulfide

The polyphenylene sulfide material prepared as set forth in Example 1 was subjected to a toner cleanability test by developing a toner image on a lab sample. An air velocity nozzle was used to blow air across the sample to remove the toner. The lower the velocity needed to remove the toner demonstrates that the toner is more easily removable. The results demonstrated cleanability by PPS of about 8.8 feet/seconds which indicates better cleaning than polyimide or polycarbonate. These results demonstrate that the material as claimed performs very well as a fuser member.

Example 10

Use of Corona Treatment of Surface to be Laminated

Three layer fuser members were prepared as in Examples 4 and 5 and the substrate and outer layer were subjected to corona treatment prior to lamination. The corona treatment was provided by HR-100 at 10 volts and at $2.96\times10^5$ ohms-cm at 70° C. and at 50 percent relative humidity. The sample was then tested for pull strength and found to be from about 232 to about 348 ounce/inch width. These results demonstrate that corona treatment prior to lamination can increase pull strength.

While the invention has been described in detail with reference to specific and preferred embodiments, it will be appreciated that various modifications and variations will be apparent to the artisan. All such modifications and embodiments as may readily occur to one skilled in the art are intended to be within the scope of the appended claims. All amounts are percentages by weight of total solids unless otherwise indicated.

We claim:

1. A fuser member comprising a substrate, wherein said substrate comprises a polyimide, and optionally thereover an optional adhesive layer, and said fuser member further having an outer layer comprising polyphenylene sulfide.

2. A fuser member in accordance with claim 1, comprising an adhesive layer positioned between said substrate and said outer layer, wherein said adhesive layer comprises a solventless adhesive.

3. A fuser member in accordance with claim 2, wherein said solventless adhesive comprises a material selected from the group consisting of epoxy resins, polyurethane resins, and silicone resins.

4. A fuser member in accordance with claim 2, wherein said solventless adhesive comprises from about 0.01 to about 3 percent solvent material.

5. A fuser member in accordance with claim 1, wherein said outer layer further comprises a filler selected from the group consisting of graphite, carbon black, boron nitride, and metal oxides.

6. A fuser member in accordance with claim 5, wherein said metal oxide is selected from the group consisting of zinc oxide, aluminum oxide, copper oxide, and mixtures thereof.

7. A fuser member in accordance with claim 5, wherein said filler is carbon black.

8. A fuser member in accordance with claim 2, wherein at least one of said substrate and said outer layer is subjected to corona treatment prior to lamination with said adhesive.

9. A fuser member in accordance with claim 8, wherein said polyphenylene sulfide layer is subjected to corona treatment prior to lamination with said adhesive.

10. A fuser member in accordance with claim 1, wherein said outer layer is subjected to fluorine treatment.

11. A fuser member in accordance with claim 1, further comprising an outer release layer positioned on said outer polyphenylene sulfide layer.

12. A fuser member in accordance with claim 11, wherein said outer release layer comprises a material selected from the group consisting of fluoropolymers, polyimides and silicone rubbers.

13. A fuser member in accordance with claim 12, wherein said fluoropolymer is selected from the group consisting of a) copolymers of vinylidene fluoride, hexafluoropropylene and tetrafluoroethylene; b) terpolymers of vinylidene fluoride, hexafluoropropylene and tetrafluoroethylene; and c) tetrapolymers of vinylidene fluoride, hexafluoropropylene, tetrafluoroethylene and a cure site monomer.

14. A fuser member in accordance with claim 12, wherein said fluoropolymer is selected from the group consisting of polyfluoroalkoxy polytetrafluoroethylene, polytetrafluoroethylene, and fluorinated ethylenepropylene copolymer.

15. A fuser member in accordance with claim 1, wherein said outer layer has a thickness of from about 2 to about 125 microns.

16. A fuser member in accordance with claim 1, wherein said substrate is in the form of a belt.

17. A fuser member in accordance with claim 1, wherein said substrate is present on a metal cylindrical roll.

18. A fuser member in accordance with claim 11, wherein said outer release layer further comprises a filler selected from the group consisting of graphite, carbon black, boron nitride, and metal oxides.

19. A fuser member in accordance with claim 18, wherein said metal oxide is selected from the group consisting of zinc oxide, aluminum oxide, copper oxide, and mixtures thereof.

20. A fuser member in accordance with claim 19, wherein said filler is carbon black.

21. An image forming apparatus for forming images on a recording medium comprising:

a charge-retentive surface to receive an electrostatic latent image thereon;

a development component to apply toner to said charge-retentive surface to develop said electrostatic latent image to form a developed image on said charge retentive surface;

a transfer component to transfer the developed image from said charge retentive surface to a copy substrate; and a fuser member to fuse said developed image to said copy substrate, said fuser member comprising a substrate comprising a polyimide, an optional adhesive layer, and an outer layer comprising polyphenylene sulfide.

22. A fuser member comprising a substrate comprising a polyimide, an adhesive layer positioned thereon wherein said adhesive layer comprises a solventless adhesive, and an outer layer positioned on said adhesive layer wherein said outer layer comprises polyphenylene sulfide, and wherein at least one of said polyimide substrate and said polyphenylene sulfide outer layer are subjected to corona treatment prior to positioning said solventless adhesive between said polyimide substrate and said polyphenylene sulfide outer layer.

* * * * *